US009683807B2

(12) United States Patent
Arnold

(10) Patent No.: US 9,683,807 B2
(45) Date of Patent: Jun. 20, 2017

(54) MAGNUS EFFECT CYLINDRICAL PROJECTILE AND LAUNCHER

(71) Applicant: L. Taylor Arnold, Raleigh, NC (US)

(72) Inventor: L. Taylor Arnold, Raleigh, NC (US)

( * ) Notice: Subject to any disclaimer, the term of this patent is extended or adjusted under 35 U.S.C. 154(b) by 0 days.

(21) Appl. No.: 14/823,808

(22) Filed: Aug. 11, 2015

(65) Prior Publication Data

US 2017/0045327 A1 Feb. 16, 2017

(51) Int. Cl.
*F41B 7/00* (2006.01)
*F41B 7/08* (2006.01)

(52) U.S. Cl.
CPC ..... *F41B 7/08* (2013.01); *F41B 7/003* (2013.01)

(58) Field of Classification Search
CPC ..... F41B 3/04; F41B 7/003; F41B 7/08
See application file for complete search history.

(56) References Cited

U.S. PATENT DOCUMENTS 36,968 A * 11/1862 Shaler ..... A63B 69/408 124/7
383,512 A * 5/1888 Barber ..... A63F 7/048 124/16
1,091,512 A * 3/1914 Hoffman ..... A63B 69/408 124/36
1,262,060 A * 4/1918 Kristofek ..... A63B 69/408 124/16
1,457,674 A * 6/1923 Kennedy ..... A01M 3/027 124/36
2,167,992 A 8/1939 Olsen
2,279,766 A * 4/1942 Truesdell ..... F41B 3/03 124/16
3,717,136 A * 2/1973 Gay et al. ..... A63F 9/02 124/21
4,016,854 A * 4/1977 Lehman ..... F41B 7/08 124/27
4,335,701 A * 6/1982 Bozich ..... A63B 69/407 124/26
4,452,007 A 6/1984 Martin
5,613,482 A * 3/1997 Thai ..... F41B 7/003 124/16

* cited by examiner

*Primary Examiner* — John Ricci
(74) *Attorney, Agent, or Firm* — LaMorte & Associates, P.C.

(57) ABSTRACT

A toy projectile and launcher system. The projectile is tubular in shape and lightweight. The projectile has an exterior surface that is symmetrically disposed about an imaginary longitudinal axis. The launcher has a holding trough that receives and holds the tubular projectile. Within the launcher is a spring loaded element. The spring loaded element selectively moves between a cocked position and a released position. The spring loaded element contacts the projectile in the holding trough as the spring loaded element moves from its cocked position to its released position. Contact with the spring loaded element causes the tubular projectile to launch into flight in a direction perpendicular to its longitudinal axis. Simultaneously, contact with the spring loaded element imparts a spinning rotation to the projectile, wherein the projectile spins about its longitudinal axis in flight. The spinning creates a Magnus effect on the projectile.

15 Claims, 6 Drawing Sheets

MAGNUS EFFECT CYLINDRICAL PROJECTILE AND LAUNCHER

BACKGROUND OF THE INVENTION

1. Field of the Invention

In general, the present invention relates to projectile launchers that launch cylindrical projectiles having a long axis, wherein the direction of projectile travel is perpendicular to the long axis. More particularly, the present invention relates to projectiles that are helped in flight by the Magnus effect.

2. Prior Art Description

If an object in flight spins around an axis that is not aligned with its direction of travel, then that object is subject to the Magnus effect. As an object in motion spins, the part of the object that is spinning into the oncoming air creates a small area of high pressure. Conversely, the part of the object that is spinning away from the oncoming air creates an area of low pressure. The areas of low pressure and high pressure produce a vectored force that can cause an object in flight to alter its direction. This movement is also known as the Magnus effect in fluid dynamics. The Magnus effect is the reason spinning baseballs curve and poorly hit golf balls slice.

In the toy industry, the Magnus effect has been used to add complexity to the flight of projectiles. Examples of such prior art toys are shown in U.S. Pat. No. 2,167,992 to Olsen, U.S. Pat. No. 4,452,007 to Martin and U.S. Pat. No. 5,067,792 to McMahon. The problem with such prior art toys is that the rotation imparted on the projectile is created by an elastic cord or string that is wrapped under tension around the projectile. The cord is pulled as the projectile is launched. The release of tensile energy imparts a rapid rotation to the projectile, therein invoking the Magnus effect.

Wrapping the projectile of a toy in a cord or string, particularly an elastic cord or elastic string, is both time consuming and awkward. It is also beyond the hand/eye skills of many children and adults. The result is that the string or cord is often wrapped loosely, or in a pattern that is prone to tangling. The result is that the projectile becomes difficult to launch and does not fly well once it is launched. Accordingly, the toy loses much of its play value and thus, its popularity and ultimately its marketability.

A need therefore exists for a toy system that launches a projectile in a manner that is highly susceptible to the Magnus effect without requiring the projectile be wrapped or otherwise tethered. In this manner, the projectile can be launched into flight quickly, easily and in a manner that can be readily mastered by even a young child. This need is met by the present invention as described and claimed below.

SUMMARY OF THE INVENTION

The present invention is a toy projectile and launcher system. The projectile is cylindrical in shape and lightweight. The projectile has an exterior surface that is symmetrically disposed about an imaginary longitudinal axis.

The launcher has a holding trough that receives and holds the tubular projectile. Within the launcher is a spring loaded element. The spring loaded element selectively moves between a cocked position and a released position. The spring loaded element is biased into its released position by a spring. When manually moved to its cocked position, the spring stores energy.

The spring loaded element contacts the projectile in the holding trough as the spring loaded element moves from its cocked position to its released position. Contact with the spring loaded element causes the tubular projectile to launch into flight in a direction perpendicular to its longitudinal axis. Simultaneously, contact with the spring loaded element imparts a spinning rotation to the projectile, wherein the projectile spins about its longitudinal axis in flight. The spinning creates a Magnus effect on the projectile that helps keep it in flight and alters its flight path.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention projectile and launcher can be embodied in many ways, only two embodiments of the invention are illustrated and described. These embodiments are selected in order to set forth some of the best modes contemplated for the invention. The illustrated embodiments, however, are merely exemplary and should not be considered limitations when interpreting the scope of the appended claims.

Figure 1:
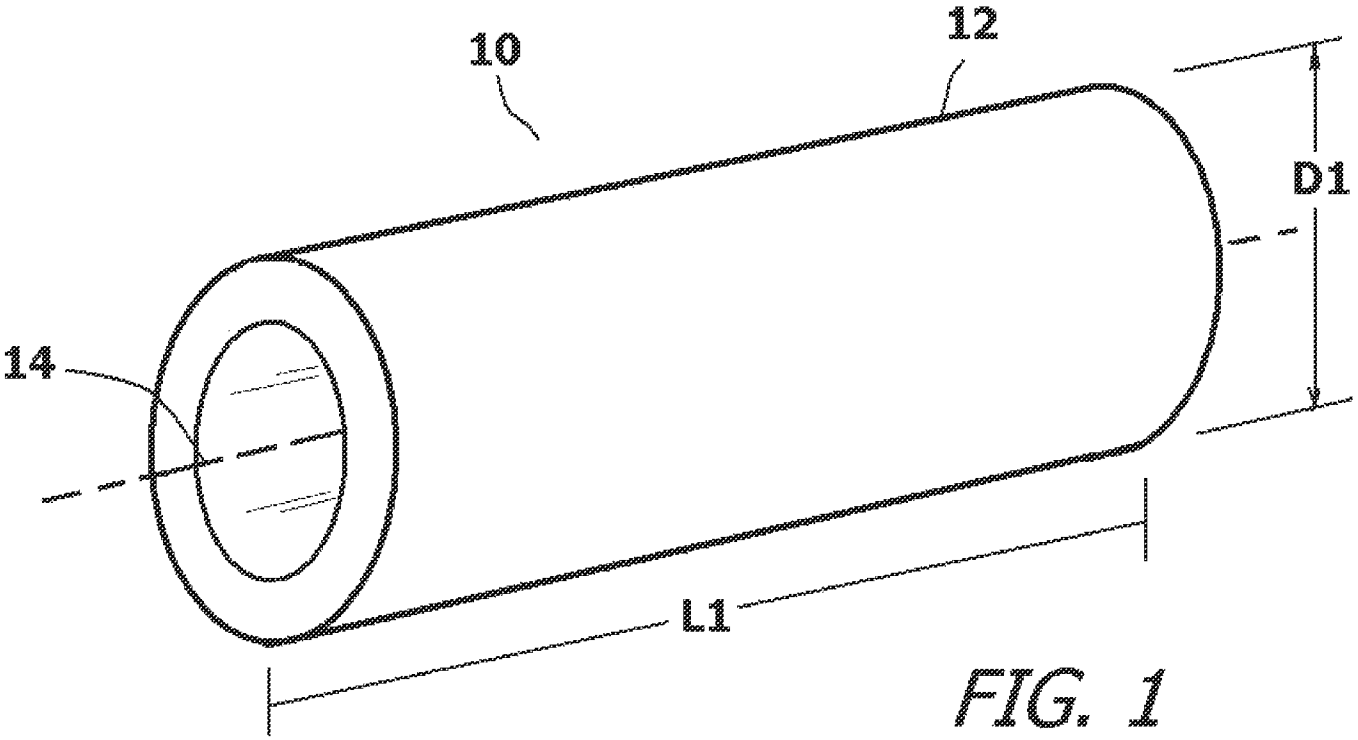
FIG. 1 is a perspective view of a projectile.
Figure 2:
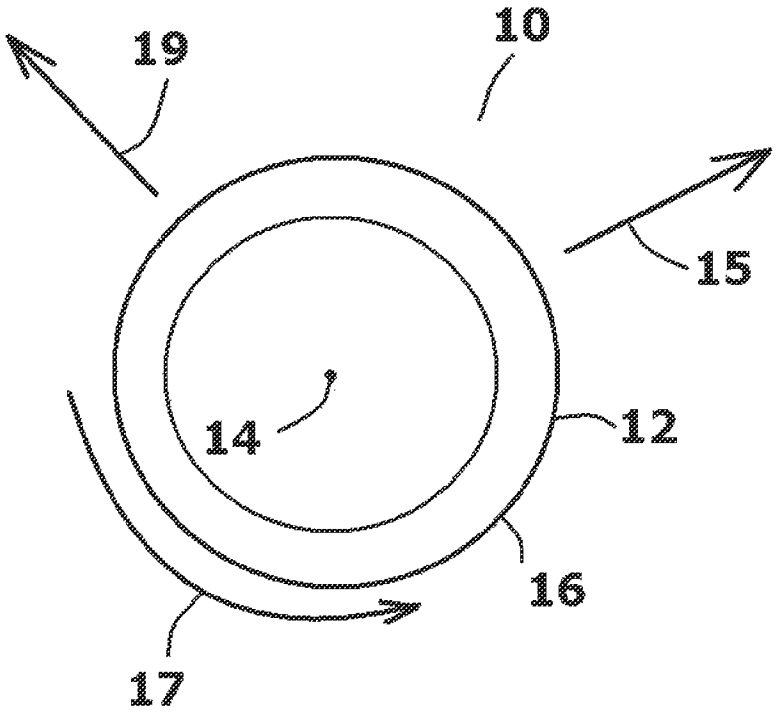
FIG. 2 is a side view of the projectile of FIG. 1 showing the forces that act upon the projectile in flight.

Referring to FIG. 1 and FIG. 2, a projectile 10 is shown. The projectile 10 has a cylindrical body 12 with a length L1 and a diameter D1. The cylindrical body 12 is mostly hollow in order to minimize weight. The length L1 is preferably at least three times as long as the diameter D1 is wide. The cylindrical body 12 is symmetrical formed about an imaginary long axis 14 that runs along its length L1 through the center of the projectile 10. The cylindrical body 12 can be fabricated from plastic or a laminated paper.

In FIG. 2, the projectile 10 is shown in flight, wherein it is traveling in the primary direction of arrow 15. As the projectile 10 is traveling in the direction of arrow 15, it is also spinning about is long axis 14 in the direction of arrow 17. The spinning of the projectile 10 moves some of the air near the exterior surface 16 of the projectile 10. This air moved by the projectile 10 creates a slight high pressure under the projectile 10 and a slight low pressure above the projectile 10. The high pressure and low pressure act upon the projectile 10 and create a vectored Magnus force in the direction of arrow 19. The Magnus force is generally perpendicular to the forward direction of flight. The Magnus force therefore initially creates an upward force that inclines the direction of flight. As the Magnus force continues, it tends to cause the projectile 10 to fly vertically in a circle, therein producing a loop in flight. As such, the Magnus force tends to cause the projectile 10 to loop and return to its point of origin.

Figure 3:
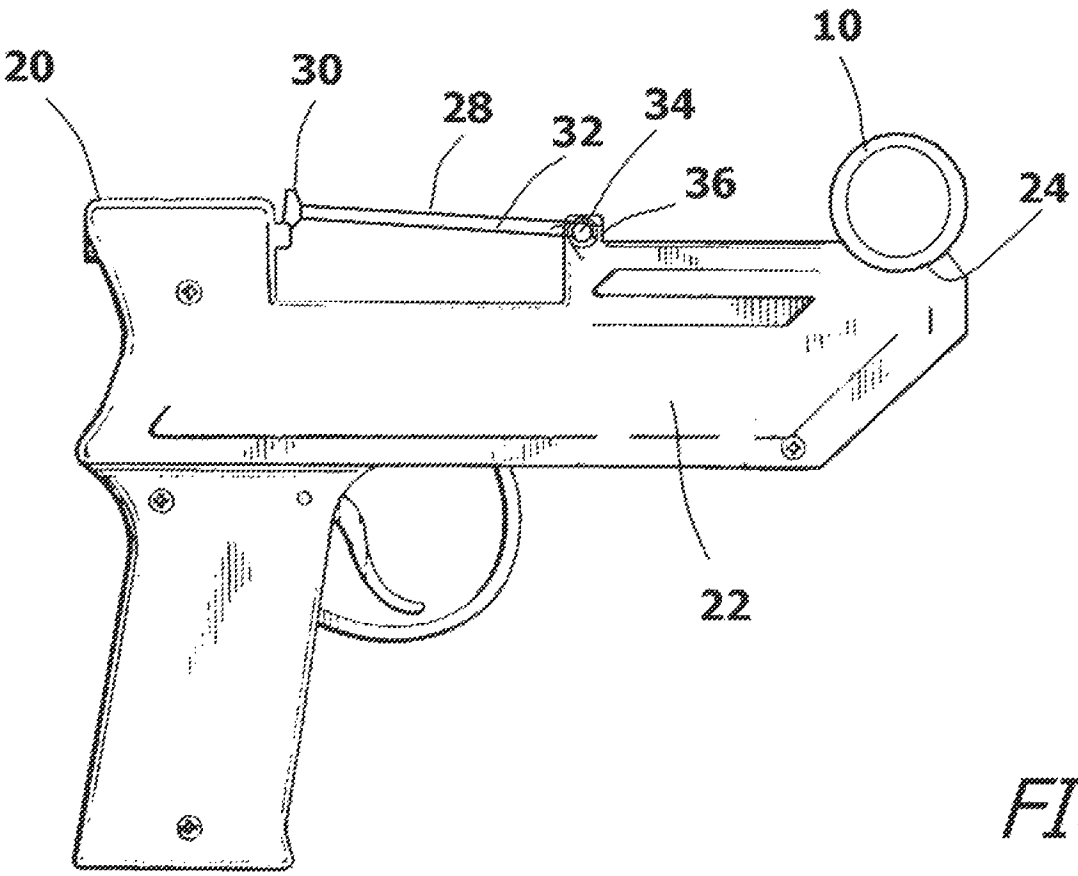
FIG. 3 is a side view of a launcher and projectile in a cocked and ready position.
Figure 4:
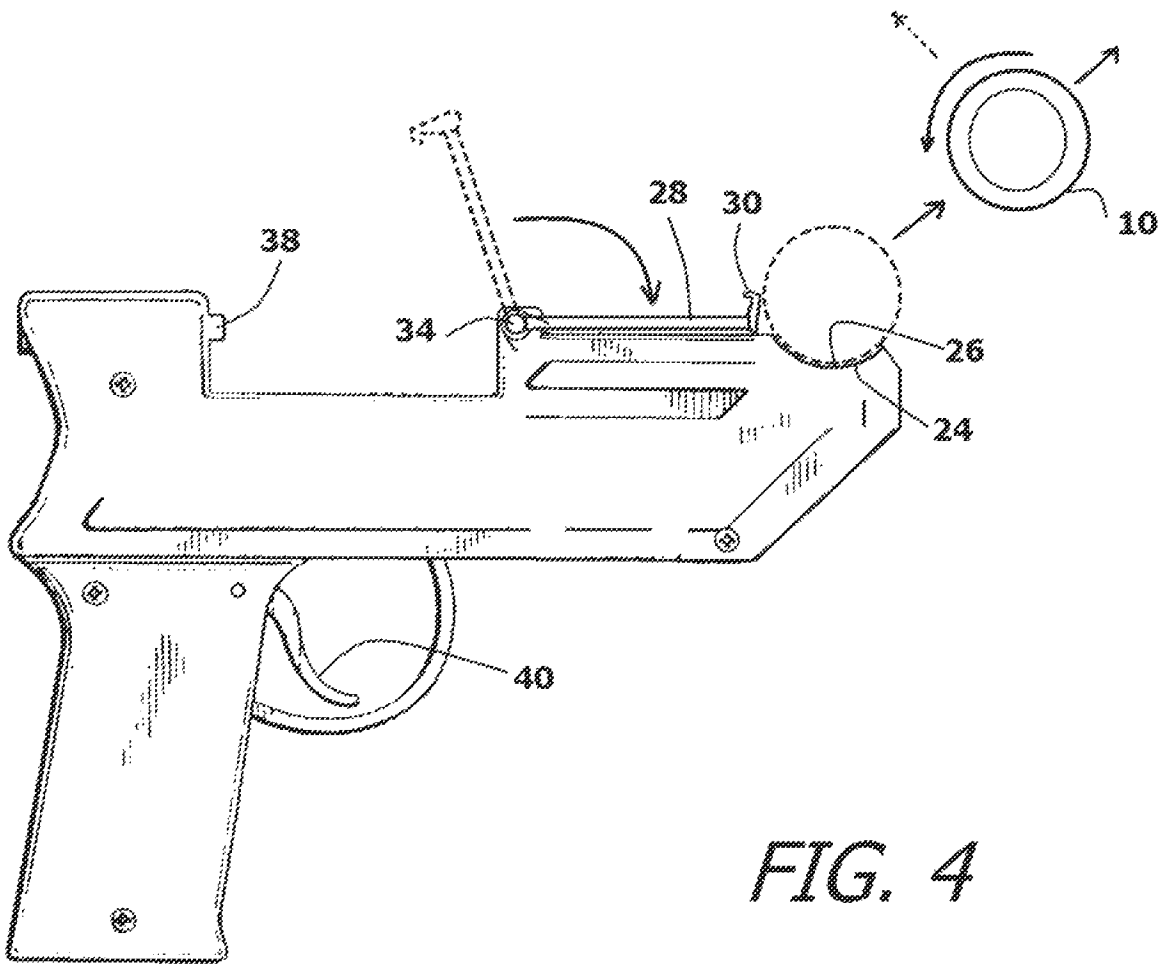
FIG. 4 shows the launcher and projectile of FIG. 3 in a released position.

Referring to FIG. 3 and FIG. 4 in conjunction with earlier figures, a first embodiment of a launcher 20 is shown. In this embodiment, the launcher 20 contains a base 22. A holding trough 24 is formed in the base 22. The holding trough 24 has an interior surface 26 that is very smooth and has a low coefficient of friction. The holding trough 24 has a radius of curvature that matches the exterior surface 16 of the projectile 10.

A spring loaded hammer 28 is provided. The hammer 28 has a head 30 that strikes the projectile 10 at a tangent. The head 30 of the hammer 28 is preferably covered in an elastomeric material that has a high degree of resiliency and a high coefficient of friction. The head 30 of the hammer 28 contacts the projectile 10 along a tangent while traveling at a high speed. This has two effects. First, it provides the projectile 10 with a large amount of rotational energy. This causes the projectile 10 to spin. Second the head 30 of the hammer 28 transfers kinetic energy to the projectile 10 and knocks the projectile 10 out of the holding trough 24 and into flight.

The hammer 28 contains one or two arms 32 that support the head 30. The arms 32 are pivotally connected to the base 22 at pivot connections 34. The arms 32 are biased into a released position that holds the head 30 immediately adjacent the holding trough 24. The spring bias is provided by one or two torsion springs 36 that connect to both the base 22 and the arms 32. The hammer 28 can be manually moved into a cocked position against the bias of the springs 36. To do this, the hammer 28 is rotated about the pivot connections 34 until the head 30 of the hammer 28 connects to a trigger catch 38. The trigger catch 38 is opened by the pulling of a trigger lever 40 under the base 22.

Once the hammer 28 is rotated to its cocked position, spring energy is stored in the springs 36. When the trigger lever 40 is pulled, the trigger catch 38 disengages the head 30. The stored spring energy then causes the hammer 28 to rotate in the manner of a mousetrap. The head 30 on the hammer 28 accelerates with the rotating hammer 28 until the head 30 strikes the side of the projectile 10.

The head 30 of the hammer 28 strikes the projectile 10 with a glancing blow that acts at a tangent to the curvature of the projectile 10. This transfers much of the energy from the hammer 28 to the projectile 10 in the form of spin. However, the contact with the hammer 28 also has the effect of displacing the projectile 10 from the holding trough 24 and launching the projectile 10 into flight. The projectile 10 rotates rapidly around its long axis 14 as it is launched into flight. The forward projection away from the holding trough 24 and the rapid rotation create a Magnus force that helps to keep the projectile 10 in flight. As previously mentioned, the projectile 10 tends to fly up and around in a looping flight path.

Figure 5:
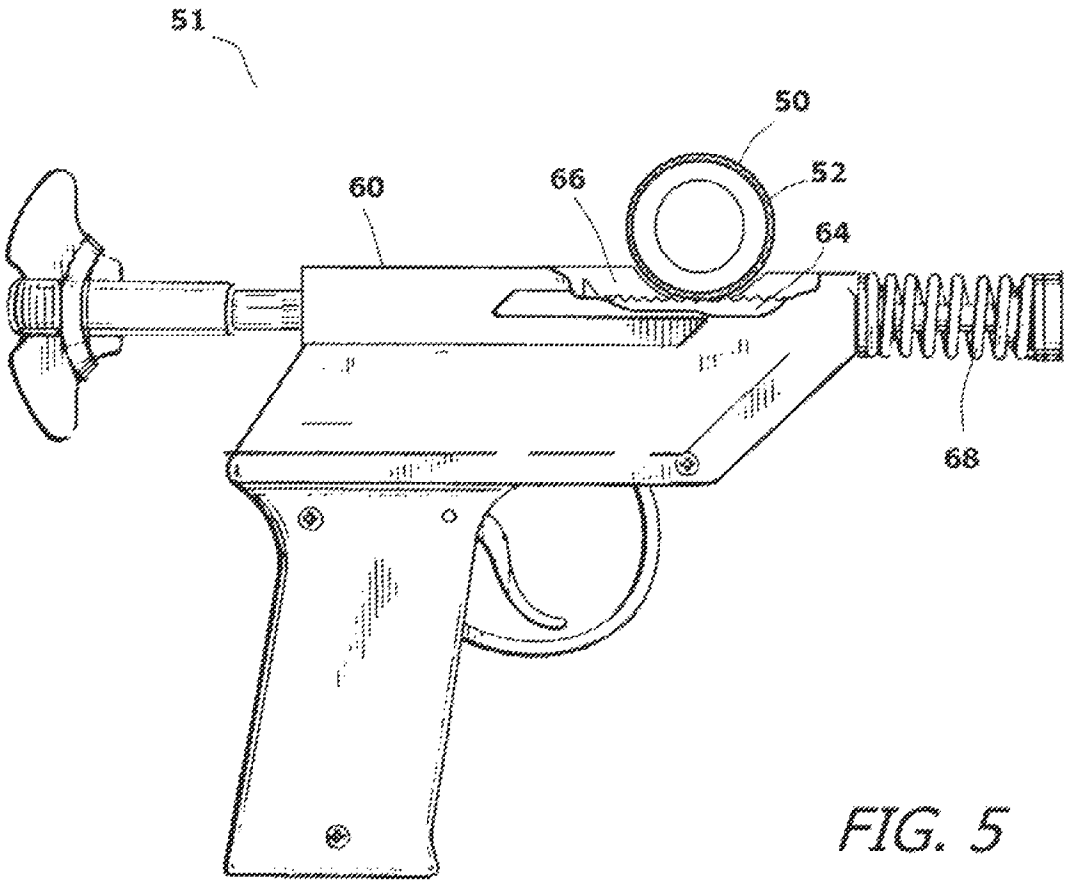
FIG. 5 shows an alternate embodiment of a launcher and projectile in a cocked and ready position.
Figure 6:
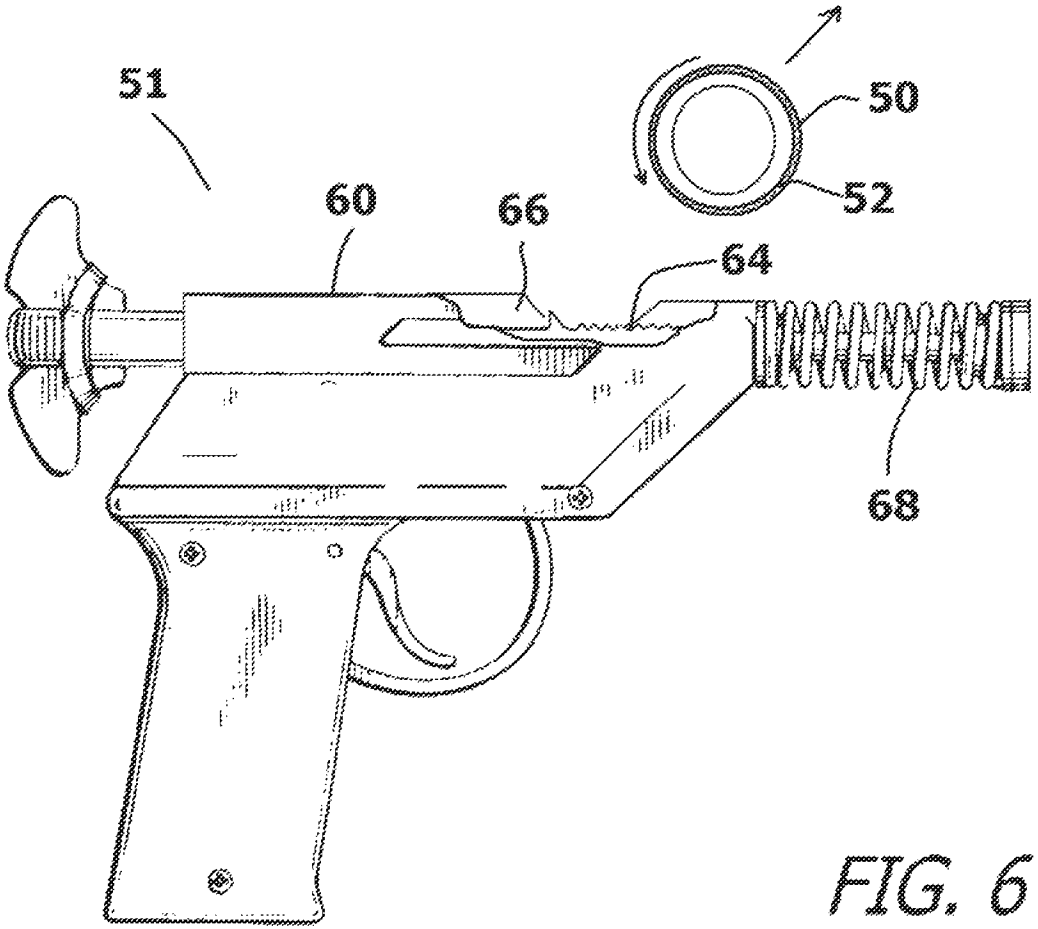
FIG. 6 shows the launcher and projectile of FIG. 5 in a released position.

Referring to FIG. 5 in conjunction with FIG. 6, an alternate embodiment of a projectile 50 and launcher 60 are described. In this embodiment, the projectile 50 is provided with a narrow ring of gear teeth impressions 52 at its midpoint along its long axis 54.

The launcher 60 has a holding trough 62 for holding the projectile 50. A gear rack 64 is provided. The gear rack 64 is disposed in a track 66 that passes through the holding trough 62. The gear rack 64 is spring loaded with a spring 68. A pull tab 70 is present at one end of the gear rack 64. When the pull tab 70 is pulled, the gear rack 64 moves horizontally in the track 66 and the spring 68 compresses. Once the spring 68 is fully compressed, the gear rack 64 engages an internal trigger catch that holds the gear rack 64 and spring 68 in a cocked position.

The trigger catch 72 is operated by a trigger lever 74. When the trigger lever 74 is pulled, the gear rack 64 is released. The spring 68 releases its stored energy and the gear rack 64 is rapidly accelerated horizontally in the track 66 from a cocked position to a released position.

The projectile 50 is placed in the holding trough 62 so that the gear teeth impressions 52 on the projectile 50 intermesh with the gear rack 64. When the gear rack 64 is released from its cocked position, the gear rack 64 rapidly moves under the projectile 50. This causes the projectile 50 to spin rapidly. As the gear rack 64 moves, the pull tab 70 eventually contacts the projectile 50. The pull tab 70 has an inclined surface 76 that strikes the projectile 50 and launches it into flight while it is spinning. The forward projection away from the holding trough 62 and the rapid rotation creates a Magnus force that helps to keep the projectile 50 in flight. As previously mentioned, the projectile 50 tends to fly up and around in a looping flight path.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A toy projectile and launcher system, comprising:

a tubular projectile having an exterior surface that is symmetrically disposed about an imaginary longitudinal axis;

a launcher having a holding trough for receiving and holding said tubular projectile thereon;

a spring loaded element, supported by said launcher, that is selectively moved between a cocked position and a released position, wherein said spring loaded element contacts said tubular projectile in said holding trough as said spring loaded element moves from said cocked position to said released position, and wherein contact with said spring loaded element causes said tubular projectile to launch into flight in a direction perpendicular to said longitudinal axis while imparting a spinning rotation in said tubular projectile about said longitudinal axis that remains while in flight.

2. The system according to claim 1, wherein said spring loaded element includes a spring that stores spring energy when said spring loaded element is in said cocked position.

3. The system according to claim 2, further including a trigger mechanism for selectively retaining said spring loaded element in said cocked position and releasing said spring loaded element into said released position when said trigger mechanism is activated.

4. The system according to claim 1, wherein said tubular projectile is cylindrical in shape.

5. The system according to claim 4, wherein said spring loaded element includes a head that strikes said exterior surface of said tubular projectile at a tangent, therein imparting rotation to said tubular projectile.

6. The system according to claim 5, wherein said holding trough is supported on a base and said spring loaded element includes an arm that supports said head, wherein said at arm is coupled to said base at a pivot connection and wherein said arm pivots about said pivot connection when said spring biased element moves from said cocked position to said released position.

7. The system according to claim 1, wherein said spring loaded element contacts said exterior surface of said tubular projectile at a tangent, and wherein said spring loaded element moves linearly from said cocked position to said released position while contacting said tubular projectile, therein imparting rotation to said tubular projectile.

8. A toy projectile and launcher system, comprising:

a tubular projectile having an exterior surface that is symmetrically disposed about an imaginary longitudinal axis;

a launcher having a base, wherein said tubular projectile is selectively positionable on said base;

a hammer coupled to said base at a pivot connection, wherein said hammer can rotate between a cocked position and a released position about said pivot connection;

a spring for biasing said hammer in said released position;

a trigger catch for retaining said hammer in said cocked position when moved to said cocked position against said spring; and a release for activating said trigger catch;

wherein said hammer strikes said exterior surface of said tubular projectile at a tangent when moving from said cocked position to said released position, therein launching said tubular projectile into flight in a direction perpendicular to said longitudinal axis and imparting a spinning rotation in said tubular projectile about said longitudinal axis.

9. The system according to claim 8, wherein said hammer includes at least one arm and a head that is moved by said arm, wherein said head strikes said cylindrical projectile when said hammer moves from said cocked position to said released position.

10. The system according to claim 9, wherein said head is fabricated from elastomeric material.

11. A toy projectile and launcher system, comprising:

a tubular projectile having an exterior surface that is symmetrically disposed about an imaginary longitudinal axis;

a launcher having a spring loaded head that moves from a cocked position to a released position, wherein said head contacts said cylindrical projectile at a tangent when moving between said cocked position and said released position and imparts both a forward velocity in a direction perpendicular to said longitudinal axis and a rotational velocity that rotates said cylindrical projectile about said longitudinal axis.

12. The system according to claim 11 further including a holding trough on said launcher for receiving and holding said tubular projectile thereon.

13. The system according to claim 11, wherein said spring loaded head includes a spring that stores spring energy when said spring loaded head is in said cocked position.

14. The system according to claim 11, further including a trigger mechanism for selectively retaining said spring loaded head in said cocked position and releasing said spring loaded head into said released position when said trigger mechanism is activated.

15. The system according to claim 11, further including a base and an arm coupled to said base at a pivot connection, wherein said arm pivots about said pivot connection when said spring biased head moves from said cocked position to said released position.

* * * * *